US009604089B2

(12) United States Patent
Cervone et al.

(10) Patent No.: US 9,604,089 B2
(45) Date of Patent: Mar. 28, 2017

(54) ROTATOR CUFF REHABILITATION MACHINE

(71) Applicant: ROTATOR CUFF REHAB, LLC, Wixom, MI (US)

(72) Inventors: Kenneth R. Cervone, Grosse Pointe Shores, MI (US); Robert J. Irvine, Highland, MI (US)

(73) Assignee: Rotator Cuff Rehab, LLC, Wixom, MI (US)

( * ) Notice: Subject to any disclaimer, the term of this patent is extended or adjusted under 35 U.S.C. 154(b) by 125 days.

(21) Appl. No.: 14/569,281

(22) Filed: Dec. 12, 2014

(65) Prior Publication Data

US 2016/0166872 A1 Jun. 16, 2016

(51) Int. Cl.

| | |
|---|---|
| ***A63B 21/08*** | (2006.01) |
| ***A63B 21/078*** | (2006.01) |
| ***A63B 21/06*** | (2006.01) |
| ***A63B 21/00*** | (2006.01) |
| ***A63B 23/035*** | (2006.01) |
| ***A63B 23/12*** | (2006.01) |
| ***A63B 24/00*** | (2006.01) |
| *A63B 69/00* | (2006.01) |

(52) U.S. Cl.

CPC .... *A63B 21/0615* (2013.01); *A63B 21/00072* (2013.01); *A63B 21/154* (2013.01); *A63B 21/159* (2013.01); *A63B 21/4035* (2015.10); *A63B 23/03508* (2013.01); *A63B 23/03541* (2013.01); *A63B 23/1209* (2013.01); *A63B 24/0087* (2013.01); *A63B 69/0057* (2013.01); *A63B 2208/0233* (2013.01); *A63B 2225/09* (2013.01)

(58) Field of Classification Search

CPC ..... A63B 21/06–21/061; A63B 21/062–21/06287; A63B 23/12–23/1295; A63B 21/15–21/159

USPC ..... 482/92–104

See application file for complete search history.

(56) References Cited

U.S. PATENT DOCUMENTS

| | | | | |
|---|---|---|---|---|
| 4,553,747 A | | 11/1985 | Pursley | |
| 4,669,451 A | | 6/1987 | Blauth et al. | |
| 4,757,992 A | * | 7/1988 | Heitsch | A63B 23/1245 482/100 |

(Continued)

FOREIGN PATENT DOCUMENTS

WO WO 94/06518 A1 3/1994

*Primary Examiner* — Stephen Crow
*Assistant Examiner* — Garrett Atkinson
(74) *Attorney, Agent, or Firm* — John A. Miller; Miller IP Group, PLC

(57) ABSTRACT

A machine for exercising the rotator cuff muscles that is operable to individually and separately isolate and exercise each of the four rotator cuff muscles while the user is in a seated position. The exercise machine includes a plurality of structural elements including a main vertical beam and a base frame operable to be positioned on the ground, where the main beam extends vertically from the base frame. The machine includes a plurality of pulleys mounted to the structural elements and a plurality of exercise cables running through the pulleys, where handles are coupled to the exercise cables. A seat is mounted to the vertical beam and the handles are positioned relative thereto to allow the user to grasp the handles and perform the several exercises for each arm.

19 Claims, 9 Drawing Sheets

(56) References Cited

U.S. PATENT DOCUMENTS 4,772,015 A * 9/1988 Carlson ..... A63B 21/4047 482/902
4,878,663 A 11/1989 Luquette
4,898,381 A * 2/1990 Gordon ..... A63B 21/00072 482/103
4,957,281 A 9/1990 Christolear, Jr.
4,988,098 A 1/1991 Miller
5,102,122 A * 4/1992 Piane, Jr. ..... A63B 21/156 482/103
5,163,451 A 11/1992 Grellas
5,179,939 A 1/1993 Donovan et al.
5,190,509 A * 3/1993 Davison, Jr. ..... A63B 21/153 482/100
5,391,132 A 2/1995 Greenwald
5,520,615 A 5/1996 Fontana et al.
5,738,616 A 4/1998 Robertson
6,007,500 A 12/1999 Quintinskie, Jr.
6,036,624 A 3/2000 Cascini
6,342,033 B1 1/2002 Walker
6,443,877 B1 * 9/2002 Hoecht ..... A63B 23/035 482/103
6,488,612 B2 * 12/2002 Sechrest ..... A63B 21/152 482/103
7,547,289 B2 6/2009 Branch
7,591,770 B2 9/2009 Stewart et al.
7,601,105 B1 * 10/2009 Gipson, III ..... A63B 21/055 482/103
7,601,108 B2 * 10/2009 Andrews ..... A61H 1/0281 482/131
7,625,318 B1 * 12/2009 Heyn ..... A63B 21/15 482/100
7,699,724 B1 4/2010 Derisse
7,775,949 B2 * 8/2010 Bowser ..... A63B 21/00043 482/121
8,057,368 B1 * 11/2011 Lyszczarz ..... A63B 21/156 482/103
8,187,152 B2 5/2012 Gravel et al.
8,251,879 B2 8/2012 Binns et al.
8,303,472 B2 11/2012 Bowser
8,485,950 B2 * 7/2013 Adams ..... A63B 21/04 482/129
2003/0100413 A1 * 5/2003 Huang ..... A63B 21/154 482/100
2005/0209055 A1 9/2005 Anders
2006/0135325 A1 6/2006 Holness
2007/0184944 A1 * 8/2007 Huang ..... A63B 21/06 482/94
2009/0170668 A1 * 7/2009 Giannelli ..... A63B 23/03533 482/94
2014/0194260 A1 7/2014 Campanaro et al.

* cited by examiner

ROTATOR CUFF REHABILITATION MACHINE

BACKGROUND OF THE INVENTION

Field of the Invention

This invention relates generally to a machine for exercising the rotator cuff muscles and, more particularly, to a machine that separately exercises each of the rotator cuff muscles by effectively isolating each muscle while the user is in a seated position.

Discussion of the Related Art

The human shoulder includes three bones, namely, the clavicle, the scapula and the humerus, which are held together in a specific spatial relationship by muscles, tendons and ligaments. The clavicle attaches the shoulder to the sternum and connects to the scapula at a bony projection, known as the acromion, that extends from the scapula along the top of the shoulder. The shoulder joint, known as the glenoid fossa, is formed where a ball at the top of the humerus fits into the scapula in a ball and socket joint, which is one of the largest and most complex joints in the human body.

A number of muscles stabilize the shoulder and allow for its proper motion. These muscles include a group of four rotator cuff muscles, namely, the supraspinatus, the infraspinatus, the teres minor, and the subscapularis. Each muscle of the rotator cuff muscle group originates on the scapula and includes a tendon that inserts on the humerus. The supraspinatus, infraspinatus and teres minor muscles originate on the posterior surface of the scapula and insert on the humeral head superiorly and posteriorly. The subscapularis muscle originates on the anterior surface of the scapula and passes in front of the humeral head to attach medially to the humeral neck. The supraspinatus muscle abducts the humerus away from the body at a 30° angle. The infraspinatus muscle abducts and externally rotates the humerus when the elbow is held at the side, immediately adjacent to the torso. The teres minor muscle externally rotates the humerus when the shoulder is abducted at 90° to the side. The subscapularis muscle internally rotates the humerus when the arm is at the side.

Together, the rotator cuff muscles provide for proper positioning of the humeral head in the glenoid socket while the shoulder is at rest by creating an inferior and medial force vector. The rotator cuff muscles also provide dynamic stability to the shoulder joint by creating a force vector that maintains proper positioning of the humeral head within the glenoid socket during active elevation of the shoulder, particularly in the first phase of the arc of motion.

The deltoid muscle is a large muscle that originates medially on the scapula along the acromion and a portion of the clavicle. The deltoid crosses the shoulder and attaches to the humerus, and functions to elevate and abduct the humerus away from the torso. The pectoralis muscle is a large muscle in the chest that inserts into the humerus and is responsible for flexing, internally rotating and adducting the humerus. Together the deltoid and pectoralis muscles pull upward and anteriorly, opposing the action of the rotator cuff muscles, which pull inferior and medially.

There exists a dynamic balance between the rotator cuff muscle group and the deltoid/pectoralis muscle group. When a healthy balance exists, there is a force coupling generated by these opposing muscle groups to allow for proper elevation of the humerus from a position where the arm is at the side to a position above the head. Without a healthy and sufficiently strong rotator cuff muscle to keep the humeral head seated properly in the glenoid, the humeral head would simply slide up the glenoid due to the unopposed action of the deltoid and pectoralis muscles until it makes contact with the acromion and is extruded out the front of the shoulder. At that point further elevation, past 30° or so, would not be possible.

The natural aging process results in a much greater decrease in rotator cuff muscle strength than in deltoid and pectoralis muscle strength. This naturally increasing imbalance results in impingement of the rotator cuff tendons as they are pinched between the humeral head and the acromion. As a person ages and/or the rotator cuff muscles are weakened, the ball of the humerus typically rides higher in the socket than desired, which acts to abrade the tendons of the rotator cuff muscles, known as rotator cuff impingement. By strengthening the rotator cuff muscles, the ball will maintain a lower, more mechanically efficient, position in the socket during elevation, thereby reducing impingement.

Rotator cuff muscle imbalances are common in sports as well. Many athletes, such as baseball players and swimmers, often wish to strengthen the rotator cuff muscles as part of their athletic training to offset over developed deltoid and pectoralis muscles. This can increase their performance and prevent rotator cuff impingement.

As with any muscle and tendon, the rotator cuff muscles are susceptible to injury, such as tears, strains, tendonitis, inflammation, bursitis, etc., as a result of damage or overuse all typically resulting in pain. The supraspinatus muscle is especially susceptible to injury and is the most commonly injured muscle of the rotator cuff muscle group.

Most diagnosed rotator cuff injuries and conditions are typically non-operative and require rehabilitation that specifically targets the rotator cuff muscles through exercise and strength training to improve the dynamic balance of the shoulder. Physicians who treat rotator cuff muscle injuries often send their patients to rehabilitation to perform rotator cuff muscle strength training and exercises under the guidance of a physical therapist. During physical therapy of the rotator cuff muscles, each of the four rotator cuff muscles needs to be separately isolated so that it fires independently of other muscles, rotator cuff or otherwise, in order for that muscle to be properly strengthened. To do this, the physical therapist will typically use resistance devices, such as bands and free weights, while the patient's arm is maintained in a specific orientation for each muscle exercised. Maintaining the patient's arm in the proper orientation is crucial to prevent other muscles not being targeted from firing during the exercise.

Once the physical therapy has ended, the patient is now on his or her own to perform the exercises without the guidance of the physical therapist. However, without the specific guidance of a therapist, it is typically very difficult for the patient to consistently replicate the exercise with proper form so that only the specific muscle being targeted is actually exercised.

Furthermore, piecemeal equipment set up, utilized at home, is cumbersome and to use it correctly requires consistent, meticulous attention to detail. For these reasons, compliance with a permanent home exercise program is notoriously poor, and in the vast majority of cases, nonexistent. This results in frequent relapses of pain and dysfunction as a result of the "honeymoon effect" of their formal physical therapy wearing off. The rotator cuff muscles once again become deconditioned and the dynamic imbalance between the rotator cuff muscles and deltoid/pectoralis muscles resumes, with the subsequent return of the impingement and symptoms.

Machines for exercising the rotator cuff muscles exist in the art for exercising the rotator cuff muscles of a user. These machines are typically pulley based, where the user moves a cable against some resistance. However, these machines are typically not suitable for isolating and targeting the individual rotator cuff muscles because they do not include any mechanisms for ensuring that the orientation of the user's arm is maintained in a correct position, thus preventing isolation of the specific, targeted rotator cuff muscle. Without ensuring isolation, the shoulder will recruit the surrounding muscles, most notably the deltoid and pectoralis muscles, further contributing to the muscle imbalance, rather than helping to correct it.

Currently, no exercise machine exists that is able to separately isolate each of the rotator cuff muscles individually, while simultaneously and specifically preventing the exercise from being performed if the user's arm is not oriented properly for the particular muscle.

Because rotator cuff muscle exercises and the existing available exercising apparatus makes it difficult to specifically isolate the rotator cuff muscles, performing shoulder exercises in an attempt to strengthen these muscles oftentimes, as mentioned above, has the opposite effect. Because the stronger deltoid and pectoralis muscles are easily and unintentionally recruited in rotator cuff exercises, the strength differential between the deltoid/pectoralis muscles and the rotator cuff muscles is further exaggerated, to the detriment of the rotator cuff muscles. Therefore, unless the rotator cuff muscles are exercised with the arm in a specific orientation, the exercise may do more harm than good. Hence, it is critical that a rotator cuff muscle exercise be performed properly, where the orientation of the user's arm is correct, depending on which specific muscle is being exercised, in order to prevent the deltoid and pectoral muscles from being unintentionally and simultaneously strengthened during the rotator cuff muscle exercise.

SUMMARY OF THE INVENTION

The present disclosure describes a machine for exercising the rotator cuff muscles that is operable to individually and separately isolate and exercise each of the four rotator cuff muscles for each arm while the user is in a seated position. The exercise machine includes a plurality of structural elements including a main vertical beam and a base frame operable to be positioned on the ground, where the main beam extends vertically from the base frame. The machine includes a plurality of pulleys mounted to the structural elements and a plurality of exercise cables running through the pulleys, where handles are coupled to the exercise cables. A seat is mounted to the vertical beam and the handles are positioned relative thereto to allow the user to grasp the handles and perform the several exercises for each arm while being seated.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a machine for exercising the rotator cuff muscles is merely exemplary in nature, and is in no way intended to limit the invention or its applications or uses.

Figure 1:
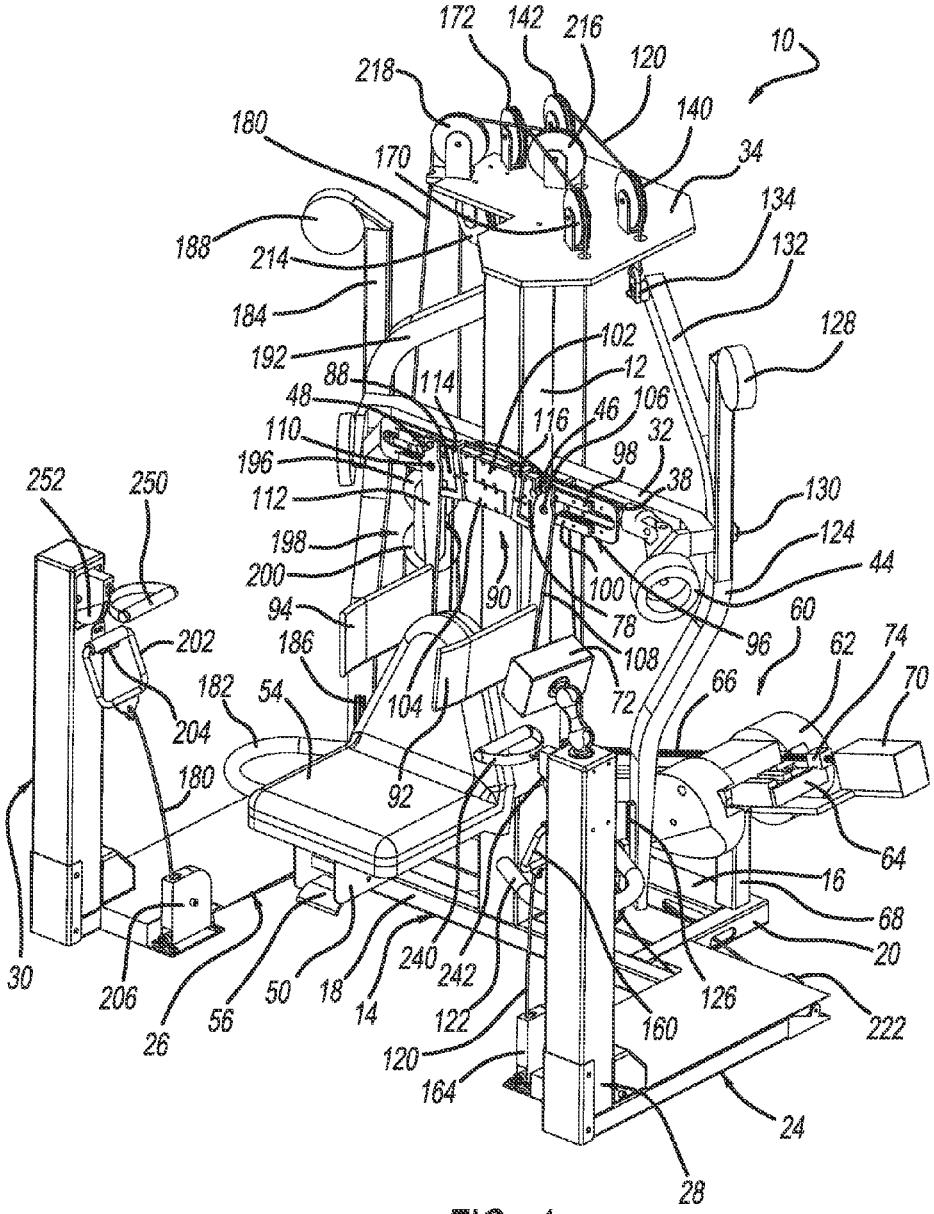
FIG. 1 is a front isometric view of a machine for exercising the rotator cuff muscles.
Figure 2:
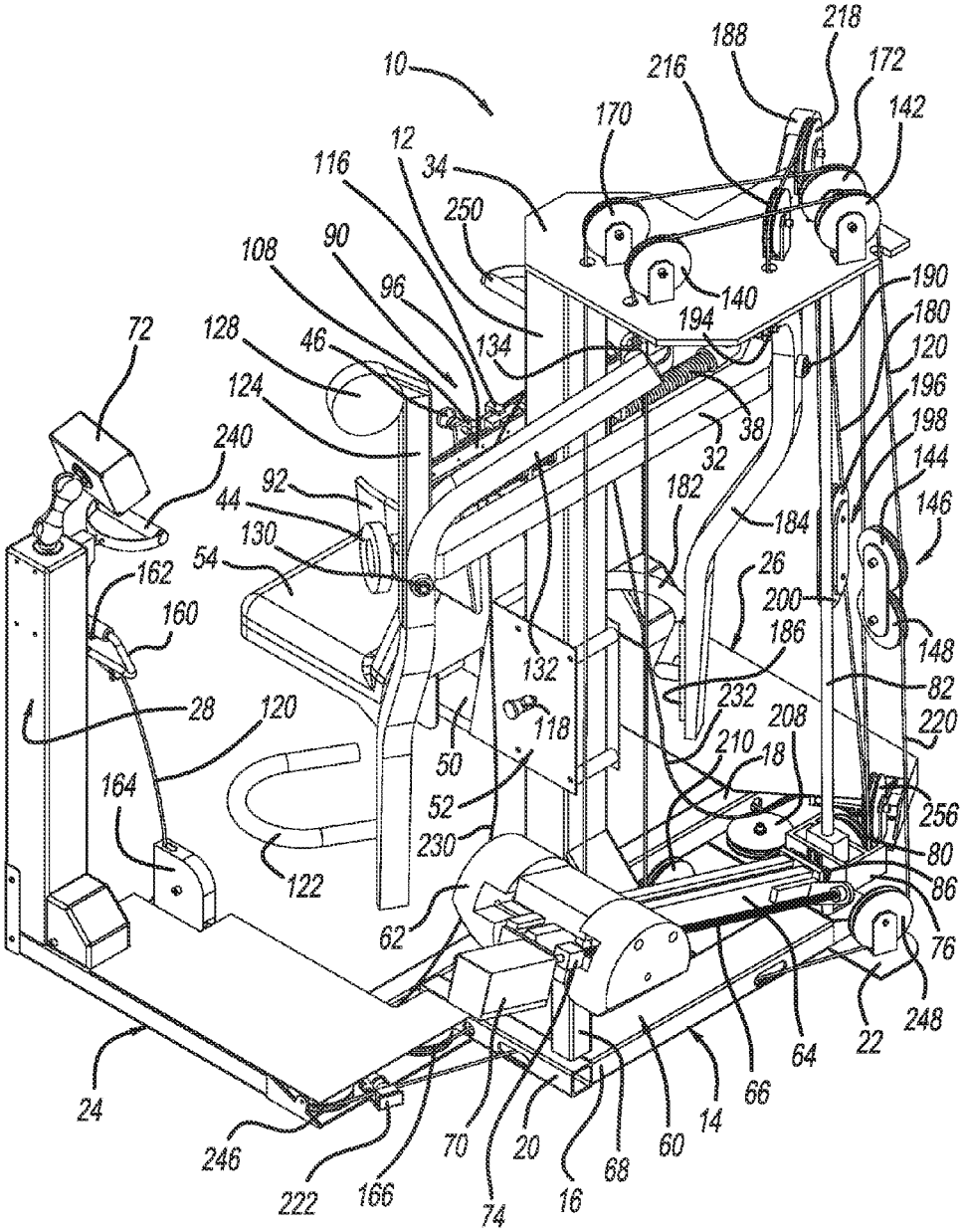
FIG. 2 is a back isometric view of the machine for exercising the rotator cuff muscles.
Figure 3:
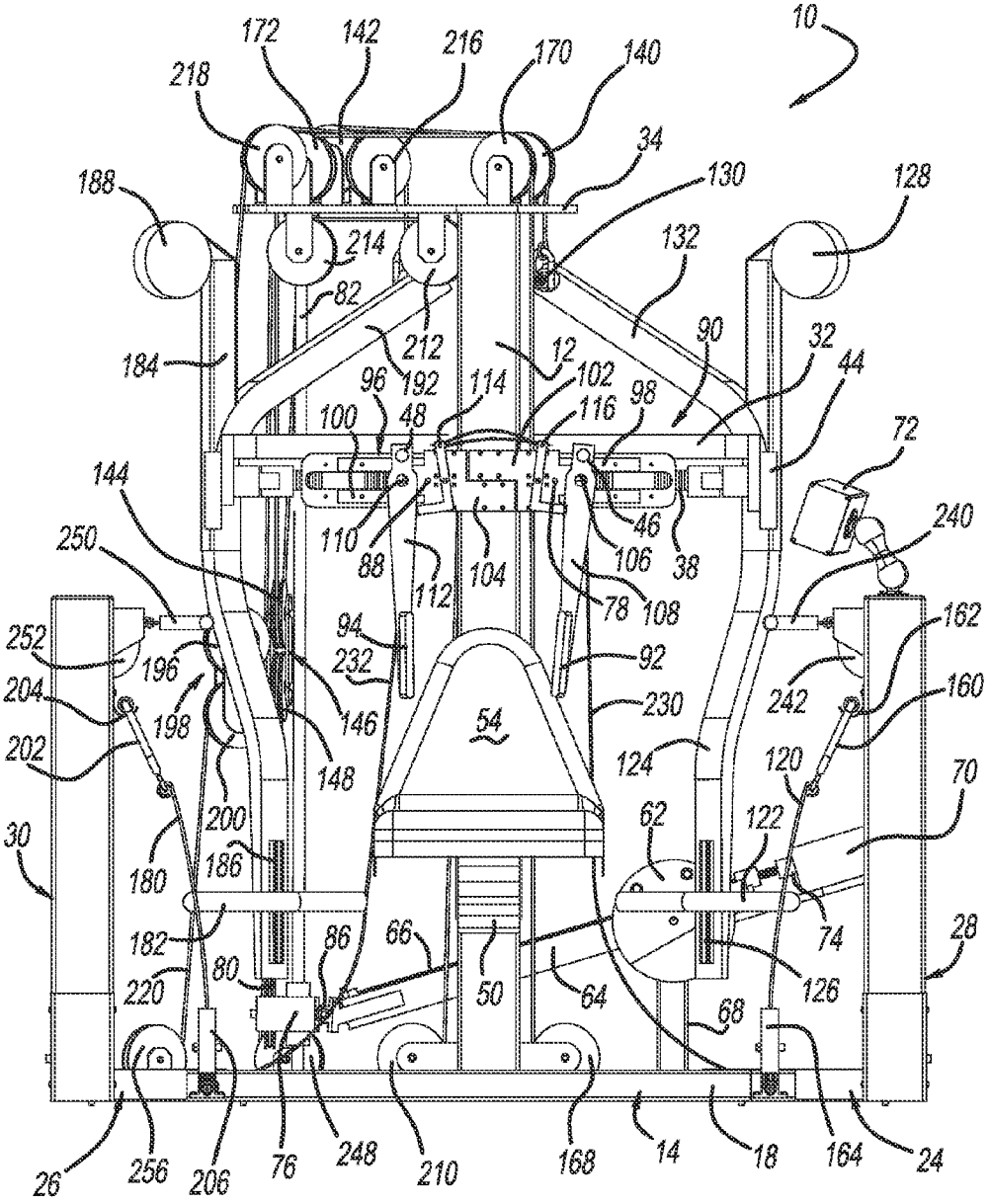
FIG. 3 is a front view of the machine for exercising the rotator cuff muscles.
Figure 4:
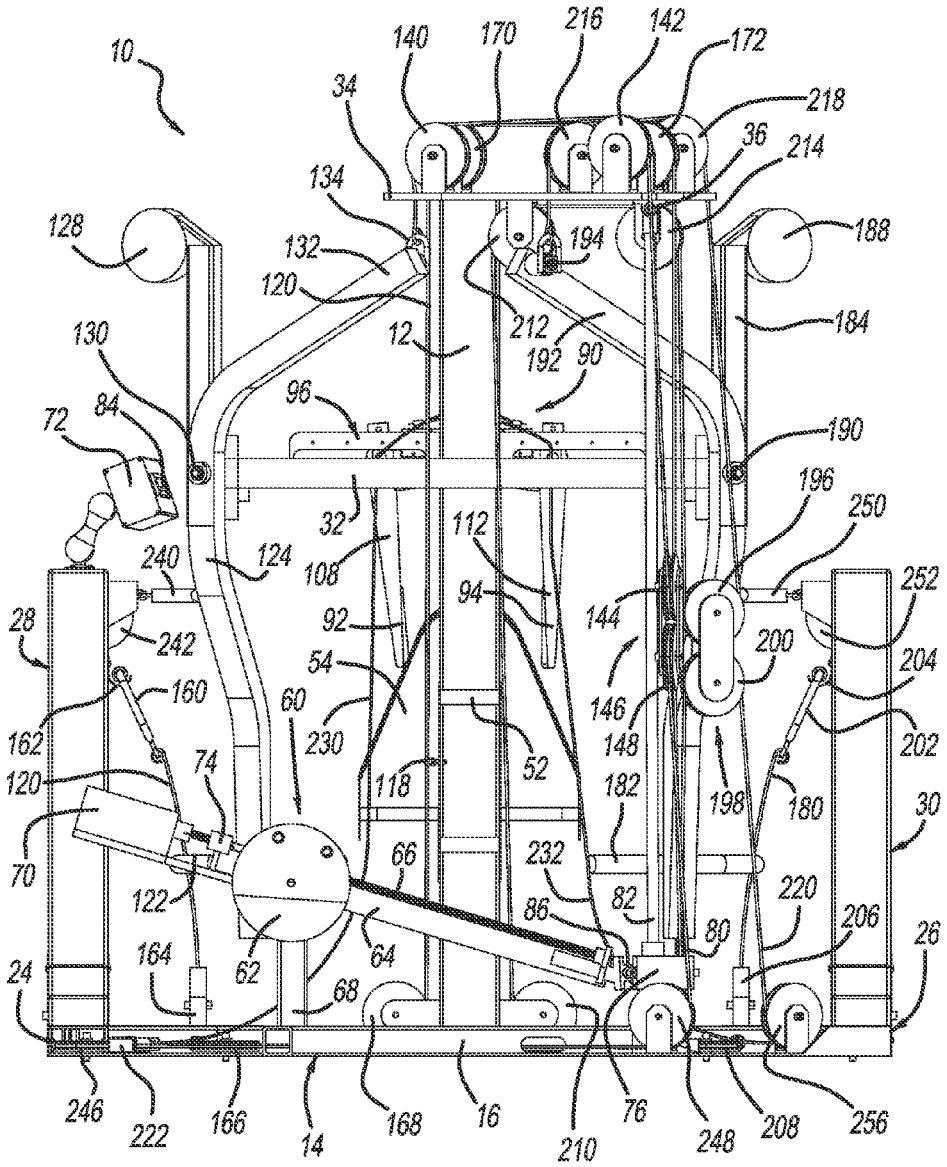
FIG. 4 is a back view of the machine for exercising the rotator cuff muscles.
Figure 5:
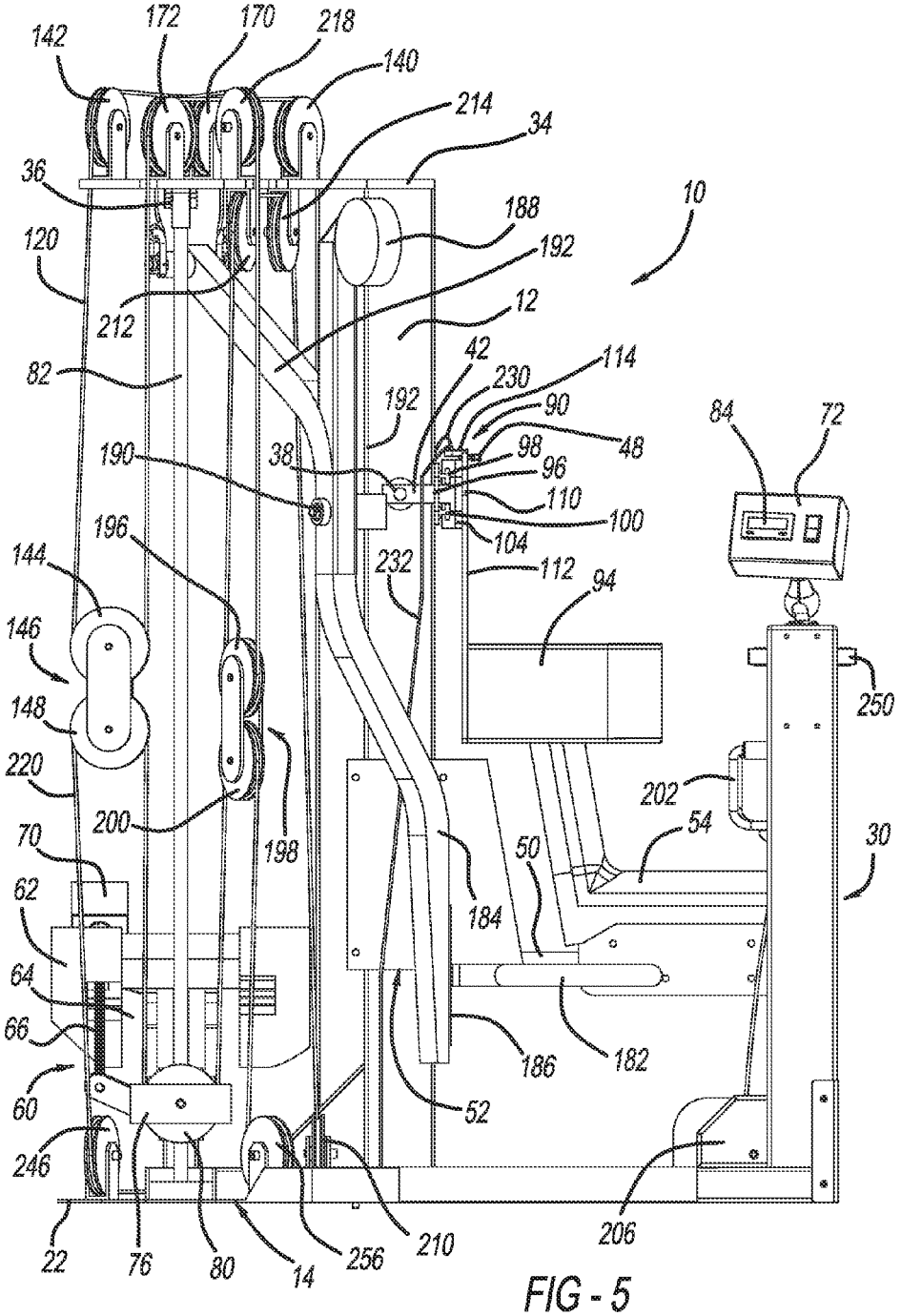
FIG. 5 is a side view of the machine for exercising the rotator cuff muscles.
Figure 6:
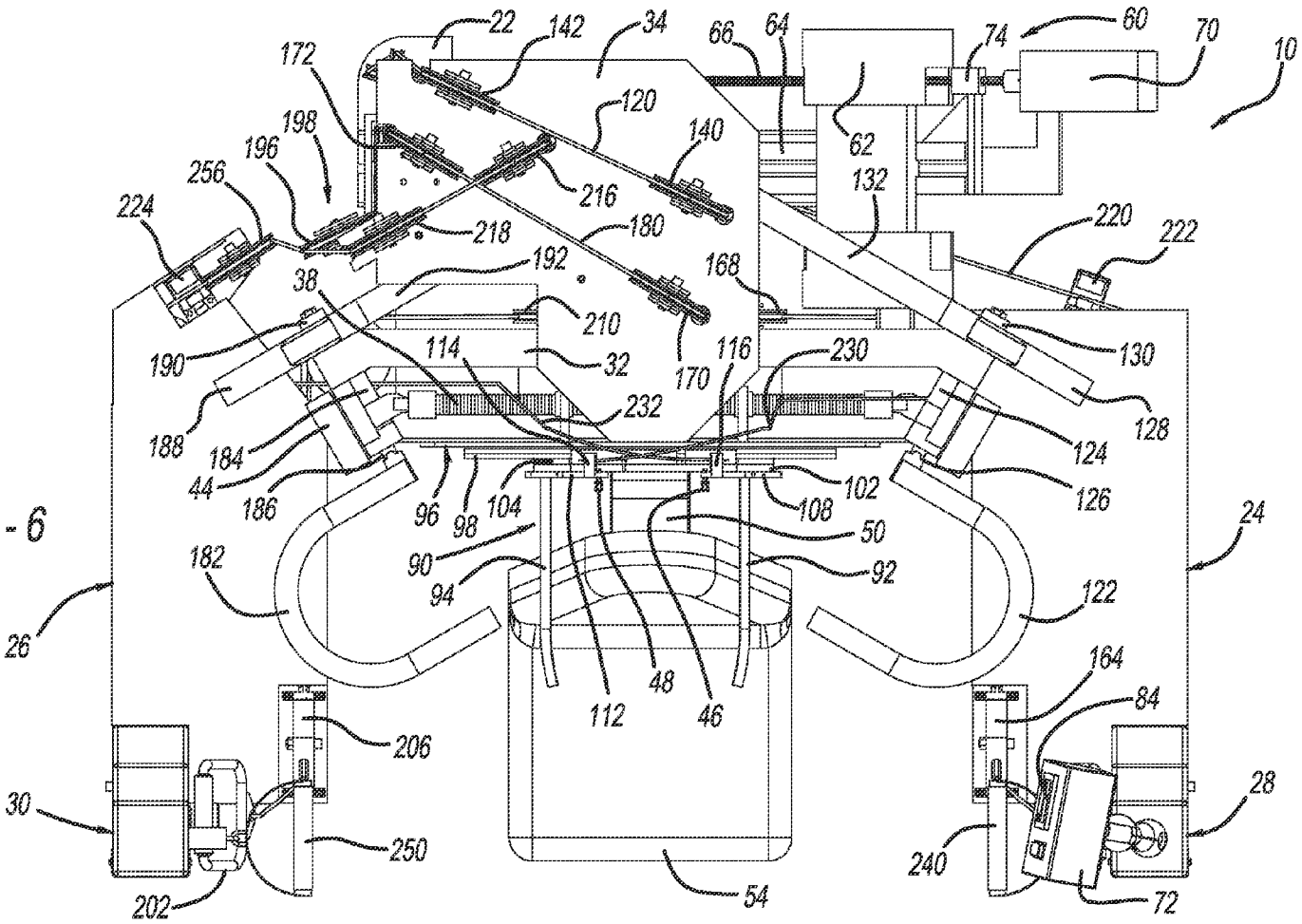
FIG. 6 is a top view of the machine for exercising the rotator cuff muscles.
Figure 7:
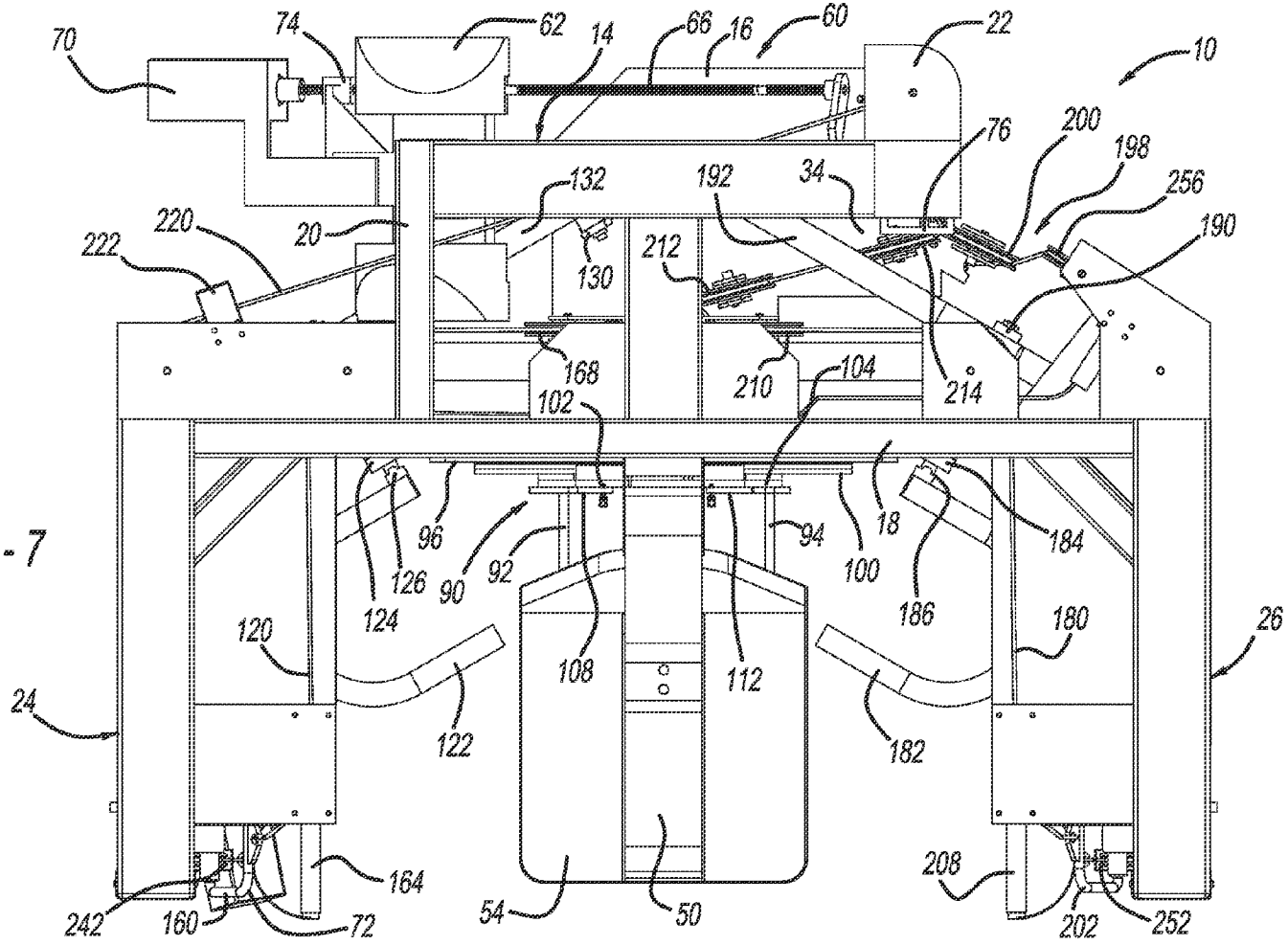
FIG. 7 is a bottom view of the machine for exercising the rotator cuff muscles.

FIG. 1 is a front isometric view, FIG. 2 is a back isometric view, FIG. 3 is a front view, FIG. 4 is a back view, FIG. 5 is a side view, FIG. 6 is a top view and FIG. 7 is a bottom view of a machine 10 for exercising the rotator cuff muscles. As will be discussed in detail below, the exercise machine 10 operates to individually and separately isolate and exercise each of the four rotator cuff muscles for both arms of a person or user using the machine 10. As will also be discussed below, the machine 10 includes a number of structural elements typically made of steel that may be powder coated and assembled together in the configuration shown using any suitable securing devices, such as welds, bolts, screws, glue, etc. The machine 10 is shown "open" so that most of the internal components of the machine 10 are visible, where the final commercial product of the exercise machine 10 will include various protective covers, show surfaces, panels, etc., where the internal components of the machine 10 may not be visible. Although some of these structural elements are shown having a general square or box configuration in this particular embodiment, that is by way of a non-limiting example in that any suitable shape for these structural elements can be employed, including round and oval shapes. Further, it is noted that the specific configuration of the structural elements is one design applicable for the features of the invention discussed herein, where other configurations may also be equally applicable. It is also noted that the machine 10 generally has left-right symmetry in that many of the elements of the machine 10 are identical on left and right sides of the machine 10 for providing exercises for both the left and right arm and shoulder of the user.

The structural support elements of the machine 10 include a main vertical beam 12 secured to a base frame 14 that sits on the floor, where the main beam 12 extends the height of the machine 10. The base frame 14 includes support bars 16, 18 and 20 and a plate 22 that define a frame structure. A left-side hollow platform 24 is secured to the left end of the base frame 14 and extends forward therefrom and a right-side hollow platform 26 is secured to a right end of the base frame 14 and extends forward therefrom. A left-side hollow vertical post 28 extends up from the platform 24 parallel to the main beam 12 at the front of the machine 10 and a right-side hollow vertical post 30 extends up from the platform 26 parallel to the main beam 12 at the front of the machine 10. A horizontal beam 32 is welded to and about half way up a back-side of the main beam 12 and extends substantially the width of the machine 10. A top plate 34 is welded to a top surface of the main beam 12 and acts as a support for some of the various pulleys that control operation of the machine 10, as will be discussed in detail below.

A seat support bar 50 extends perpendicularly from the main beam 12 and a seat 54 is slidably mounted to the support bar 50. The orientation of the left-side and right-side of the machine 10 as discussed herein is relative to the left and right arms of a person sitting in the seat 54 and facing forward with their back to the beam 12. The bar 50 is mounted to a slide mechanism 52 that is capable of being slid along some distance of the length of the main beam 12 and be locked at different seating height locations for users of different heights by a suitable hook and pin design, or other suitable structure. For example, a spring loaded pull pin 118 mounted to the mechanism 52 may be retracted into a support opening in the beam 12, where the pin 58 can be withdrawn from the opening against the spring bias to move the mechanism 52 to a higher or lower location where the pin 58 is released to be inserted into to another opening at that level. The seat 54 is also positionable at different distances from the main beam 12 along the bar 50 by activating a release lever 56 also for different sized users.

A weight assembly 60 including a cylindrical weight 62 is mounted to the base frame 14, as shown. The weight assembly 60 includes an angled weight beam 64 on which the weight 62 is mounted, where the weight 62 is positionable at any location along the beam 64 by a linear screw 66 to increase or decrease the lifting load of the exercise for any weight within a certain range. In this non-limiting embodiment, an electric motor 70 controlled by a control box 72 mounted to a top of the post 28 electrically rotates the linear screw 66, and a linear actuator 74 measures the position of the weight 62. The control box 72 includes a display 84 that displays the selected weight. The size of the weight 62 can be any suitable weight, such as 100 lbs. A top end of the beam 64 is pivotally mounted to a post 68 extending from the bar 18 of the frame 14. An opposite end of the beam 64 is pivotally mounted to a support box 76 by a pivot joint 86 that is liftable therefrom during operation of the machine 10, as will be discussed in detail below. A pulley 80 is rotatably mounted in the box 76 and a stabilizing bar 82 extends through the box 76, where a lower end of the bar 82 is slidably positioned on the plate 22 and a top end of the bar 82 is pivotally mounted to the top plate 34 by a pivot pin 36. Each of the exercises discussed below causes the box 76 to be lifted along the bar 82, where the box 76 rides on linear bearings (not shown) on the bar 82, and where the bar 82 keeps the pulley 80 aligned with a pulley assembly, discussed below. The location of the weight 62 on the beam 64 determines how much weight resistance the user will feel, and where the amount of weight for a particular exercise increases as the weight 62 is moved closer to the box 76.

The machine 10 also includes a gull wing assembly 90 mounted to a front side of the main beam 12 opposite to the horizontal bar 32 and above the seat 54. The gull wing assembly 90 including a back plate 96 mounted to the beam 12 and having an upper track 98 and a lower track 100. A left-side slide assembly 102 and a right-side slide assembly 104 are slidably mounted by slide bearings on the tracks 98 and 100. The assembly 90 also includes a left-side gull wing 92 and right-side gull wing 94 shown in their down position substantially perpendicular to the ground in FIGS. 1-7. The gull wing assembly 90 is shown separated from the machine 10 in FIG. 8 with the gull wings 92 and 94 in their up and locked position substantially parallel to the ground. A spring loaded pin 46 is pulled out to release the pin 46 from an opening 78 in the slide assembly 102 to allow the gull wing 92 to be rotated to its down position, and a spring loaded pin 48 is pulled out to release the pin 48 from an opening 88 in the slide assembly 104 to allow the gull wing 94 to be rotated to its down position.

Figure 9:
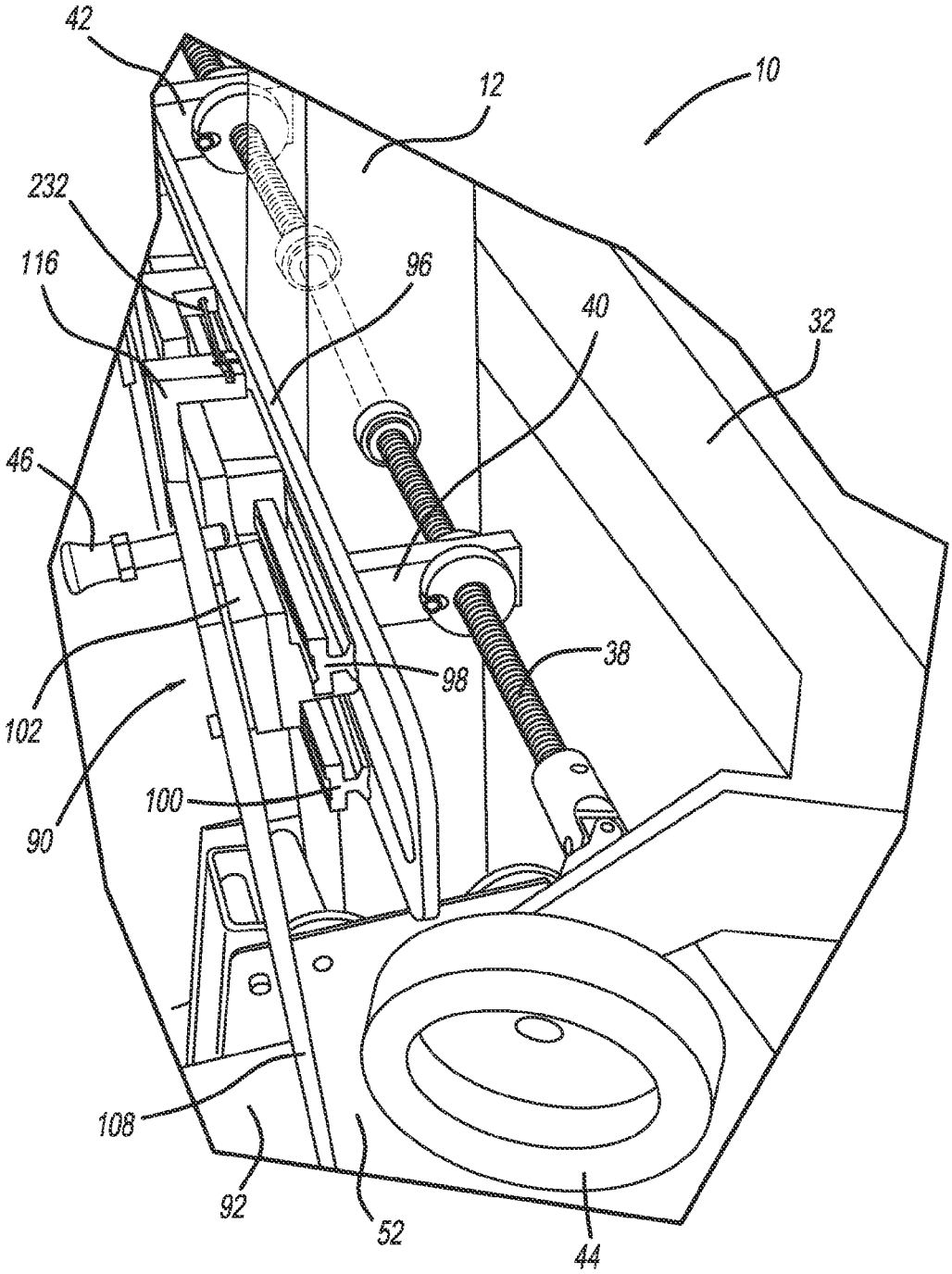
FIG. 9 is a cut-away isometric view of the machine for exercising the rotator cuff muscles better illustrating the linear screw for positioning the gull wings.

The slide assemblies 102 and 104 can be positioned at any location along the length of the tracks 98 and 100 to position the gull wings 92 and 94 closer or farther apart depending on the size of the particular user. In this embodiment, the position of the assemblies 102 and 104 is set by a linear screw 38 that extends through the beam 12. FIG. 9 is a cut-away isometric view of the machine 10 better illustrating the linear screw 38. A bracket 40 is slidably mounted to the screw 38 and rigidly mounted to the assembly 102 and a bracket 42 is slidably mounted to the screw 38 and rigidly mounted to the assembly 104. Rotation of a knob 44 in either the clockwise or counter-clockwise direction causes the screw 38 to rotate in the clockwise or counter-clockwise direction to move the assemblies 102 and 104 together or apart. The gull wing 92 is mounted to the slide assembly 102 at pivot rod 106 by a bar 108, and the gull wing 94 is mounted to the slide assembly 104 at pivot rod 110 by a bar 112, where the pivot rods 106 and 110 allow the gull wings 92 and 94 to be rotated between the up and down positions for different exercises, as will be discussed below.

As will be discussed in detail below, the user will sit in the seat 54 to exercise each of the separate rotator cuff muscles for both the user's right shoulder and left shoulder by lifting the weight 62. Each exercise requires a combination of certain handles, pulleys, cables, etc. interconnected to the various structural elements of the machine 10 discussed above. Those various handles, pulleys, cables and other components will be specifically identified through a discussion of each separate exercise below.

A first exercise cable 120 is employed for the exercises for the left-side supraspinatus muscle and the left-side teres minor muscle. The components used to exercise the left-side supraspinatus muscle include a U-shaped handle 122 that is slidably mounted to a lower end of a specially configured bar 124 along a track 126 so as to be self-adjusting for different sized users. A counter weight 128 is rigidly mounted to an opposite end of the bar 124 from the handle 122. The bar 124 is pivotally mounted to a left-side end of the horizontal bar 32 by a pivot bolt 130. A cable bar 132 is rigidly mounted to and extends from the bar 124 proximate the pivot bolt 130 and includes a coupler 134 at an opposite end from the bar 124 to which one end of the cable 120 is secured. The cable 120 extends through an opening in the plate 34, around a pulley 140 mounted to a top surface of the plate 34 and around a pulley 142 also mounted to the top surface of the plate 34. The cable 120 then extends down through an opening in the plate 34 and around an upper pulley 144 that is part of a pulley assembly 146 that includes a lower pulley 148.

The components used to exercise the left-side teres minor muscle include a handle 160 held in a handle holder 162 when not in use, where the handle 160 is coupled to an opposite end of the first cable 120 from the bar 124. This end of the cable 120 wraps around a pulley (not shown) positioned within a pulley housing 164, around a pulley 166 mounted within the platform 24, around a pulley 168 mounted to a left-side bottom end of the main beam 12, extends through an opening in the top plate 34, around a pulley 170 mounted to the top surface of the top plate 34, around a pulley 172 also mounted to the top surface of the top plate 34, and back through an opening in the top plate 34 to the upper pulley 144.

To exercise the left-side supraspinatus muscle, the user holds the handle 122 with his or her thumb pointing towards their body and lifts their arm upward away from their body so that the bar 124 pivots on the pivot bolt 130. The orientation of the bar 124 maintains the angle of the lifting motion of the user's arm at 30° relative to a plane through the user's body, which is the required angle to specifically isolate the supraspinatus muscle without firing other muscles. As the user lifts up on the handle 122 and the bar 124 pivots on the pivot bolt 130, the end of the cable 120 coupled to the coupler 134 is drawn downward away from the plate 34 lifting up on the pulley 144, where the cable 120 on the other side of the pulley 144 is anchored by the handle 160. Lifting the pulley 144 lifts the pulley assembly 146, which pulls up on the pulley 80, which pulls a third cable discussed below, which lifts the weight beam 64 causing the box 76 to move along the rod 82 against the weight 62. When the bar 124 is pivoted on the pivot bolt 130, and the counter weight 128 goes over center, the counter weight 128 counters the weight of the handle 122 so that the true weight of the weight 62 is being lifted.

Figure 8:
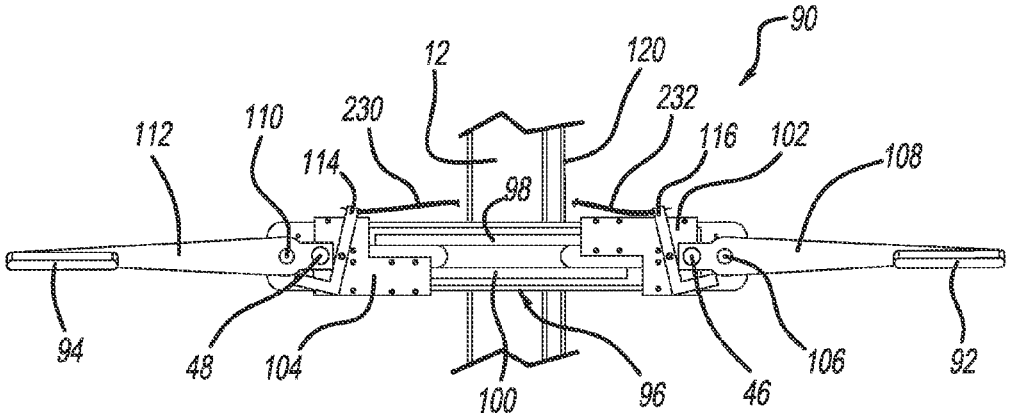
FIG. 8 is a cut-away front view of the machine for exercising the rotator cuff muscles showing the gull wings in an up position.

To exercise the left-side teres minor muscle, the user will position the left-side gull wing 92 in its up and locked position as shown in FIG. 8 and will rest their left upper arm on top of the gull wing 92. The height of the seat 54 is adjusted so that the upper arm of the user is substantially parallel to the floor on the gull wing 92 during this exercise. While in this position, the user will hold the handle 160 and externally rotate their shoulder while resting their upper arm on the gull wing 92. This motion draws the cable 120 and causes the pulley 144 and the pulley assembly 146 to be raised, thus raising the weight beam 64 and the weight 62 in the manner discussed above. The cable 120 on other side of the pulley 144 is anchored by the bar 124.

A second exercise cable 180 is employed for the exercises for the right-side supraspinatus muscle and the right-side teres minor muscle. The components used to exercise the right-side supraspinatus muscle include a U-shaped handle 182 that is slidably mounted to a lower end of a specially configured bar 184 along a track 186 so as to be self-adjusting for different sized users. A counter weight 188 is rigidly mounted to an opposite end of the bar 184. The bar 184 is pivotally mounted to the right-side end of the horizontal bar 32 by a pivot bolt 190 opposite to the pivot bolt 130. A cable bar 192 is rigidly mounted to and extends from the bar 184 proximate the pivot bolt 190 and includes a coupler 194 at an opposite end from the bar 184 to which one end of the second cable 180 is secured. The cable 180 extends through an opening in the plate 34, around a pulley 216 mounted to a top surface of the plate 34 and around a pulley 218 also mounted to the top surface of the plate 34. The cable 180 then extends down through an opening in the plate 34 and around an upper pulley 196 that is part of a pulley assembly 198 that includes a lower pulley 200.

The components used to exercise the right-side teres minor muscle include a handle 202 held in a handle holder 204 when not in use, where the handle 202 is coupled to an opposite end of the second cable 180 from the bar 184. This end of the cable 180 wraps around a pulley (not shown) positioned in a pulley housing 206, around a pulley 208 mounted within the platform 26, around a pulley 210 mounted to a right-side bottom end of the main beam 12 opposite to the pulley 168, around a pulley 212 mounted to a bottom surface of the plate 34, around a pulley 214 also mounted to a bottom surface of the plate 34, and then to the upper pulley 196.

To exercise the right-side supraspinatus muscle, the user holds the handle 182 with their thumb pointing towards their body and lifts their arm upward away from their body so that the bar 184 pivots on the pivot bolt 190. The orientation of the bar 184 maintains the angle of the lifting motion of the user's arm at 30° relative to a plane through the user's body, which is the required angle to specifically isolate the supraspinatus muscle without firing other muscles. As the user lifts up on the handle 182 and the bar 184 pivots on the pivot bolt 190, the cable 180 is drawn downward lifting up on the upper pulley 196, where the cable 180 on the other side of the pulley 196 is anchored by the handle 202. Lifting the pulley 196 lifts the pulley assembly 198, which pulls up on the pulley 80, which pulls the third cable, discussed below, which lifts the end of the weight beam 64 causing the box 76 to move along the rod 82 against the weight 62. The rod 82 keeps the pulley 80 aligned with the pulley assembly 198. When the bar 184 is pivoted on the pivot bolt 190, and the counter weight 188 goes over center, the counter weight 188 counters the weight of the handle 182 so that the true weight of the weight 62 is being lifted.

To exercise the right-side teres minor muscle, the user will position the right-side gull wing 94 in its up and locked position as shown in FIG. 8 and will rest their left forearm on top of the gull wing 94. The height of the seat 54 is adjusted so that the upper arm of the user is substantially parallel to the floor on the gull wing 94 during this exercise. While in this position, the user will hold the handle 202 and extendedly rotate their shoulder while resting their upper arm on the gull wing 94. This motion draws the cable 180 and causes the pulley 196 and the pulley assembly 198 to be raised, thus raising the weight beam 64 and the weight 62 in the manner discussed above. The cable 180 on other side of the pulley 196 is anchored by the bar 184.

Figure 10:
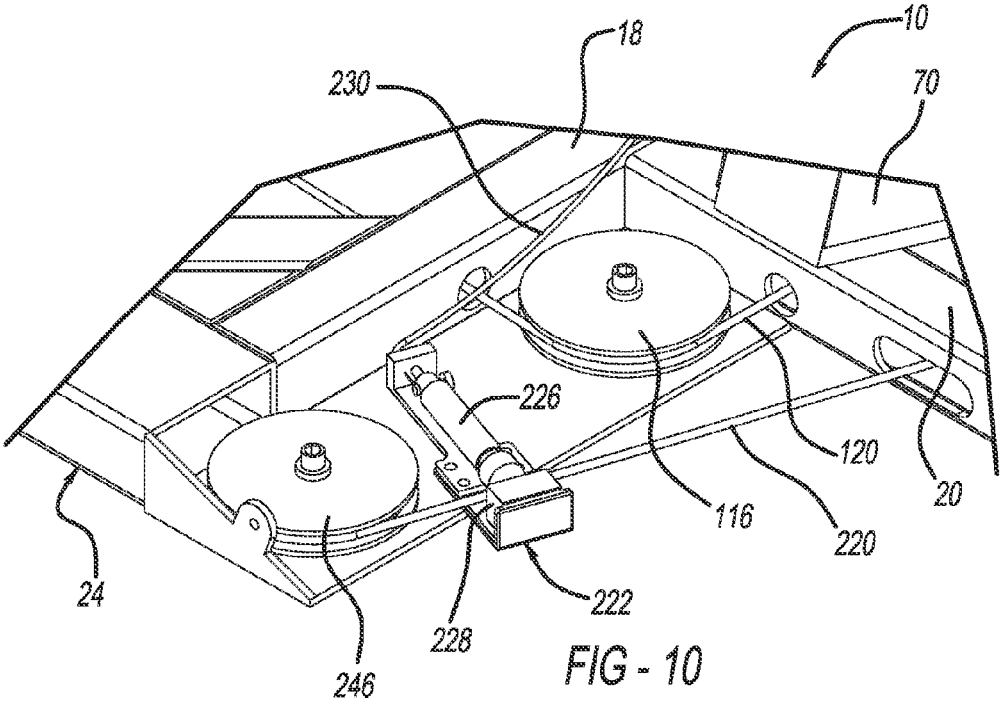
FIG. 10 is a cut-away view of the machine for exercising the rotator cuff muscles showing one of the cable brakes.

A third cable 220 is employed for all of the exercises for the left-side infraspinatus muscle, the right-side infraspinatus muscle, the left-side subscapularus muscle and the right-side subscapularus muscle. It is necessary that the user hold their upper arm against their body and pivot their forearm away from their body in order for the infraspinatus muscle to be isolated and the exercise to be performed properly. To insure that this happens, the machine 10 includes a left-side cable brake 222 and a right-side cable brake 224, where a broken-away view of the machine 10 is shown in FIG. 10 highlighting the left-side cable brake 222. The brakes 222 and 224 include a spring loaded piston 226 that pushes the cable 220 against a braking bumper 228 to prevent it from moving. The piston 226 is pulled away from the bumper 228 against the spring force by activating a left-side brake cable 230 for the left-side brake 222 and a right-side brake cable 232 for the right-side brake 224. An end of the brake cable 230 opposite to the brake 222 is coupled to a right-side lever 114 pivotally mounted to the right-side slide assembly 104 so that when the user pushes their right upper arm against an outside surface of the gull wing 94 when it is in the down position and against their body, the lever 114 pivots, which draws the cable 230 to release the brake 222. Likewise, an end of the brake cable 232 opposite to the brake 224 is coupled to a left-side lever 116 pivotally mounted to the left-side slide assembly 102 so that when the user pushes their left upper arm against an outside surface of the gull wing 92 when it is in the down position and against their body, the lever 116 pivots, which draws the cable 232 to release the brake 224.

The components used to perform the exercises for both the right-side infraspinatus muscle and the left-side subscapularus muscle include a handle 240 coupled to one end of the cable 220. The cable 220 extends around a pulley 242 mounted in the top end of the post 28, around a pulley (not shown) mounted in a bottom end of the post 28, around a pulley 246 mounted at a back end of the platform 24, around a pulley 248 mounted to the plate 22, around the lower pulley 148 and to the pulley 80. Likewise, the components used to perform the exercises for both the left-side infraspinatus muscle and the right-side subscapularus muscle include a handle 250 coupled to an opposite end of the cable 220. The cable 220 extends around a pulley 252 mounted in a top end of the post 30, around a pulley (not shown) mounted in a bottom end of the post 30, around a pulley 256 mounted to a back end of the platform 26 and around the lower pulley 200 to the pulley 80.

When performing the right-side infraspinatus muscle exercise, the user will hold their upper right arm against the gull wing 94 to release the brake 222 as described above. With the brake 222 released, the user will also hold the handle 240 in their right hand and pivot their right forearm at the elbow, away from their body, which draws the cable 220 through the pulleys 242, 246, 248 and 148, which causes the pulley 80 and thus the end of the weight beam 64 to be lifted because the opposite end of the cable 220 is held by the brake 224. Likewise, when the user performs the left-side subscapularus muscle exercise the user will hold their right upper arm against the gull wing 94 to release the brake 222. With the brake 222 released, the user will hold the handle 240 in their left hand and pull in towards their umbilicus, which draws the cable 220 through the pulleys 242, 246, 248 and 148, which causes the pulley 80 and thus the end of the weight beam 64 to be lifted against the weight 62 because the opposite end of the cable 220 is held by the brake 224.

When performing the left-side infraspinatus muscle exercise, the user will hold their upper left arm against the gull wing 92 to release the brake 224 as described above. With the brake 224 released, the user will also hold the handle 250 in their left hand and pivot their left forearm at the elbow, away from their body which draws the cable 220 through the pulleys 252, 256 and 148, which causes the pulley 80 and thus the end of the weight beam 64 to be lifted because the opposite end of the cable 220 is held by the brake 222. Likewise, when the user performs the right-side subscapularis muscle exercise the user will hold their left upper arm against the gull wing 92 to release the brake 224. With the brake 224 released, the user will hold the handle 250 in their right hand and pull the handle 250 towards their umbilicus, which draws the cable 220 through the pulleys 252, 256, and 200, which causes the pulley 80 and thus the weight beam 64 to be lifted against the weight 62 because the opposite end of the cable 220 is held by the brake 222.

The foregoing discussion disclosed and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An exercise machine comprising:

a plurality of structural elements including a main vertical beam and a base frame operable to be positioned on the ground, said main beam extending vertically from the base frame;

a plurality of pulleys mounted to the structural elements;

a plurality of exercise cables running through the pulleys;

a plurality of handles coupled to the exercise cables;

a seat mounted to the vertical beam, wherein the configuration and orientation of the structural elements, pulleys, cables and handles allow a user seated in the seat to independently exercise each of the user's right-side supraspinatus muscle, right-side infraspinatus muscle, right-side subscapularis muscle, right-side teres minor muscle, left-side supraspinatus muscle, left-side infraspinatus muscle, left-side subscapularis muscle, and left-side teres minor muscle without targeting any other muscle for exercise;

a gull wing assembly including a back plate mounted to the vertical beam above the seat, said gull wing assembly including a left-side gull wing and a right-side gull wing both being pivotably mounted relative to the back plate, said left-side gull wing and said right-side gull wing being positioned in a down position for the exercises for the left-side infraspinatus muscle, the right-side infraspinatus muscle, the left-side subscapularis muscle and the right-side subscapularis muscle and being positioned in an up position for the exercises for the left-side supraspinatus muscle, the right-side supraspinatus muscles, the left-side teres minor muscle and the right-side teres minor muscle; and a left-side brake cable coupled at one end to the left-side brake and at another end to the right-side gull wing and a right-side brake cable coupled at one end to the right-side brake and at another end to the left-side gull wing, wherein pushing the left-side gull wing inward when in the down position causes the right-side brake to be released and pushing the right-side gull wing inward when in the down position causes the left-side brake to be released.

2. The exercise machine according to claim 1 wherein the gull wing assembly includes a left-side slide assembly and a right-side slide assembly that are mounted on slide bearings positioned on the back plate, said left-side gull wing being mounted to the left-side slide assembly and said right-side gull wing being mounted to the right-side slide assembly so as to allow the gull wings to be spaced closer or farther apart for different sized users.

3. The exercise machine according to claim 1 wherein one of the plurality of cables runs through both the left-side brake and the right-side brake, wherein the user is required to apply inward pressure to the right-side gull wing to release the left-side brake when performing the right-side infraspinatus muscle exercise and the left-side subscapularis muscle exercise and is required to apply inward pressure to the left-side gull wing to release the right-side brake when performing the left-side infraspinatus muscle exercise and the right-side subscapularis muscle exercise.

4. The exercise machine according to claim 1 wherein the plurality of exercise cables is three exercise cables, wherein a first one of the exercise cables is used for the exercises for the left-side supraspinatus muscle and the left-side teres minor muscle, a second one of the exercise cables is used for both the exercises for the right-side supraspinatus muscle and the right-side teres minor muscle, and a third one of the exercise cables is used for the exercises for the left-side infraspinatus muscle, the right-side infraspinatus muscle, the left-side subscapularus muscle and the right-side subscapularus muscle.

5. The exercise machine according to claim 4 wherein the plurality of pulleys include a weight lifting pulley, a first pulley assembly including an upper pulley and a lower pulley and second pulley assembly including an upper pulley and a lower pulley, wherein the first exercise cable runs through the upper pulley of the first pulley assembly, the second exercise cable runs through the upper pulley of the second pulley assembly and the third exercise cable runs through the lower pulley of the first pulley assembly, the weight lifting pulley and the lower pulley of the second pulley assembly.

6. The exercise machine according to claim 5 wherein the structural elements include a left-side vertical post positioned at a left-side front of the machine and a right-side vertical post positioned at a right-side front of the machine, wherein the plurality of handles includes a first handle mounted to a top end of the left-side post and being coupled to one end of the third cable and a second handle mounted to a top end of the right-side post and being coupled to an opposite end of the third cable, and wherein the third cable runs through a plurality of other pulleys in addition to the lower pulley of the first pulley assembly, the weight lifting pulley and the lower pulley of the second pulley assembly.

7. The exercise machine according to claim 5 wherein the plurality of handles include a first handle coupled to one end of the first cable and being used to exercise the left-side teres minor muscle and a second handle coupled to one end of the second cable and being used to exercise the right-side teres minor muscle.

8. The exercise machine according to claim 7 wherein the structural components include a horizontal beam mounted to the main beam above the seat, said exercise machine further comprising a left-side exercise bar pivotably mounted to a left end of the horizontal beam and a right-side exercise bar pivotably mounted to a right end of the horizontal beam, said left-side and right-side exercise bars each including a bar handle slidably mounted to a lower end of the exercise bar and a counter weight rigidly mounted to an upper end of the exercise bar, wherein an end of the left-side exercise bar opposite to the bar handle is coupled to an opposite end of the first cable from the first handle and an end of the right-side exercise bar opposite to the bar handle is coupled to an end of the second cable from the second handle, and wherein the left-side exercise bar is used to exercise the left-side supraspinatus muscle and the right-side exercise bar is used to exercise the right-side supraspinatus muscle.

9. The exercise machine according to claim 8 wherein the left-side exercise bar and the right-side exercise bar are configured and positioned to maintain an angle of 30° between the user's arm and a plane running through the user's body when performing the exercise.

10. The exercise machine according to claim 1 further comprising a weight assembly including a weight and a weight bar where the weight is movable along the weight bar and where the weight bar is mounted to the base frame at a pivot point, wherein moving the weight on the weight bar relative to the pivot point increases or decreases the weight of the exercises.

11. The exercise machine according to claim 10 wherein the position of the weight on the weight bar is selectively set by an electric motor and a linear screw.

12. The exercise machine according to claim 10 wherein one of the structural components is a top plate mounted to a top of the main beam, wherein a plurality of the pulleys are mounted to the top plate.

13. The exercise machine according to claim 12 further comprising a stabilizing bar pivotally coupled to the bottom of the top plate, wherein an end of the weight bar is slidably mount to the stabilizing bar, said stabilizing bar maintaining an alignment between a pulley mounted to the weight bar and another pulley.

14. The exercise machine according to claim 1 wherein the seat is slidably mounted to a seat bar, said seat bar being mounted to the main beam perpendicular thereto.

15. An exercise machine for independently exercising each of a right-side supraspinatus muscle, a right-side infraspinatus muscle, a right-side subscapularis muscle, a right-side teres minor muscle, a left-side supraspinatus muscle, a left-side infraspinatus muscle, a left-side subscapularis muscle and a left-side teres minor muscle of a user of the machine, all while remaining seated, said machine comprising:

a plurality of structural elements including a base frame operable to be positioned on the ground, a main vertical beam coupled to and extending up from the base frame, a top plate mounted to a top of the main beam opposite to the base frame and a cross-beam secured to the main beam between the top plate and the base frame;

a plurality of pulleys including pulleys mounted to a top and bottom surface of the top plate and the base frame;

a first exercise bar pivotally mounted to a left-side end of the cross-beam and a second exercise bar pivotally mounted to a right-side end of the cross-beam;

a first exercise cable including a first end and a second end, said first end of said first exercise cable being coupled to a first handle and said second end of the first exercise cable being coupled to the first exercise bar, said first exercise cable running through a plurality of the plurality of pulleys between the first handle and the first exercise bar, wherein the first handle is used by the user to exercise the left-side teres minor muscle and the first exercise bar is used by the user to exercise the left-side supraspinatus muscle;

a second exercise cable including a first end and a second end, said first end of the second exercise cable being coupled to a second handle and said second end of the second exercise cable being coupled to the second exercise bar, said second exercise cable running through a plurality of the plurality of pulleys, wherein the second handle is used by the user to exercise the right-side teres minor muscle and the second exercise bar is used by the user to exercise the right-side supraspinatus muscle; and a third exercise cable including a first end and a second end, said first end of the third exercise cable being coupled to a third handle and said second end of the third exercise cable being coupled to a fourth handle, said third exercise cable running through a plurality of the plurality of pulleys between the third handle and the fourth handle, wherein the third handle is used by the user to exercise the right-side infraspinatus muscle and the left-side subscapularus muscle and the fourth handle is used by the user to exercise the left-side infraspinatus muscle and the right-side subscapularus muscle.

16. The exercise machine according to claim 15 wherein the structural elements include a left-side vertical post positioned at a left-side front of the machine and a right-side vertical post positioned at a right-side front of the machine, wherein the third handle is mounted to a top end of the left-side post and the fourth handle is mounted to a top end of the right-side post.

17. The exercise machine according to claim 15 wherein the left-side exercise bar and the right-side exercise bar are configured and positioned to maintain an angle of 30° between the user's arm and a plane running through the user's body when performing the exercise.

18. The exercise machine according to claim 15 further comprising one or more braking mechanisms that are released by the user in a manner that requires the right-side and left side infraspinatus muscle exercises to be performed correctly.

19. An exercise machine comprising:

a plurality of structural elements including a main vertical beam and a base frame operable to be positioned on the ground, said main beam extending vertically from the base frame;

a plurality of pulleys mounted to the structural elements;

a plurality of exercise cables running through the pulleys;

a plurality of handles coupled to the exercise cables;

a seat mounted to the vertical beam, wherein the configuration and orientation of the structural elements, pulleys, cables and handles allow a user seated in the seat to independently exercise each of the user's right-side supraspinatus muscle, right-side infraspinatus muscle, right-side subscapularis muscle, right-side teres minor muscle, left-side supraspinatus muscle, left-side infraspinatus muscle, left-side subscapularis muscle, and left-side teres minor muscle without targeting any other muscle for exercise; and a weight assembly including a weight and a weight bar where the weight is movable along the weight bar and where the weight bar is mounted to the base frame at a pivot point, wherein moving the weight on the weight bar relative to the pivot point increases or decreases the weight of the exercises, and wherein the position of the weight on the weight bar is selectively set by an electric motor and a linear screw.

* * * * *